United States Patent [19]

Scheller

[11] 4,040,774

[45] Aug. 9, 1977

[54] APPARATUS FOR CONSTRUCTING CONCRETE WALLS

[75] Inventor: Herman Scheller, Eaton, Colo.

[73] Assignee: Research-Cottrel, Inc., Bound Brook, N.J.

[21] Appl. No.: 681,723

[22] Filed: Apr. 29, 1976

[51] Int. Cl.[2] ..... E04G 11/04; E04G 11/28

[52] U.S. Cl. ..... 425/65; 249/20; 254/139

[58] Field of Search ..... 425/63–65; 249/20–22; 264/33–34; 254/139, 142

[56] References Cited

U.S. PATENT DOCUMENTS

| | | | |
|---|---|---|---|
| 661,318 | 11/1900 | Nelson | 254/139 |
| 957,521 | 5/1910 | Talbot | 249/20 |
| 3,472,477 | 10/1969 | Juhl | 249/20 |
| 3,521,336 | 7/1970 | Rohlf | 425/63 |
| 3,761,551 | 9/1973 | Ogata et al. | 264/33 |
| 3,779,678 | 12/1973 | Scheller | 425/65 |

*Primary Examiner*—Francis S. Husar
*Assistant Examiner*—John McQuade
*Attorney, Agent, or Firm*—Harold L. Stowell

[57] ABSTRACT

In an apparatus for constructing high-rising, poured concrete walls, pairs of spaced-apart, upright supports are preliminarily mounted on a foundation and then detachably attached to both sides of at least a partially hardened level of concrete wall and at intervals along the length of the wall for repeated, upward, step-wise use as the wall is being formed; a plurality of carriages are mounted on adjacent supports along both sides of the wall for continuous upward movement as the wall is being cast, and adjustable concrete shaping assemblies are mounted on the carriages. Each assembly opposing a similar assembly to define a continuous mold into which new concrete is poured on top of previously poured concrete to form the wall.

3 Claims, 10 Drawing Figures

APPARATUS FOR CONSTRUCTING CONCRETE WALLS

CROSS-REFERENCE TO RELATED SUBJECT MATTER

Related subject matter is disclosed and claimed in my U.S. Pat. No. 3,779,678 granted Dec. 18, 1973.

BACKGROUND OF THE INVENTION

Modern concrete wall casting techniques frequently utilize pairs of spaced-apart, shaping forms held in position by various types of movable supports. the concrete being poured between te forms and on top of the section of wall poured earlier and partially set. After the last poured concrete has at least partially set, the forms are removed and relocated above the former position and then the procedure is repeated until the wall is completed.

SUMMARY OF THE INVENTION

This invention provides a new and improved apparatus for efficient casting of shaped concrete walls and, in the exemplary embodiment, includes a plurality of pairs of spaced-apart, upright supports extending from the foundation initially and then attached to opposing sides of the wall being formed along the entire length of the wall, sections of each support being detachable at the bottom of the support and from the wall at intervals and re-attached at the upper end of the support to form a continuously advancing support as the wall is formed.

DESCRIPTION OF THE PREFERRED EMBODIMENT

Figure 1:
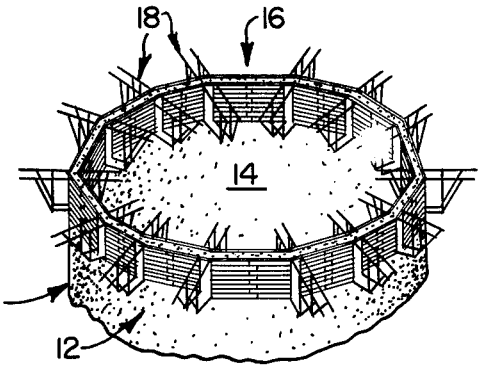
FIG. 1 is a perspective, stylized view of the base portion of a cooling tower veil being formed by the casting apparatus of this invention.

The preferred embodiment of the apparatus is set forth herein, for illustrative purposes, in connection with the construction of a concrete veil or outside wall of a nature draft cooling tower, which frequently rises 450 feet above the ground and has a diameter of 350 feet at ground level. In such construction, the round concrete wall decreases in diameter as it rises until narrow section or throat is reached, and then increases in diameter toward the top to form the hyperbolic shape. As illustrated in FIG. 1, the tower veil or wall 10 has an outer surface 12 and an inner surface 14, and a series of carriages 18 located entirely around the top of the wall.

Figure 2:
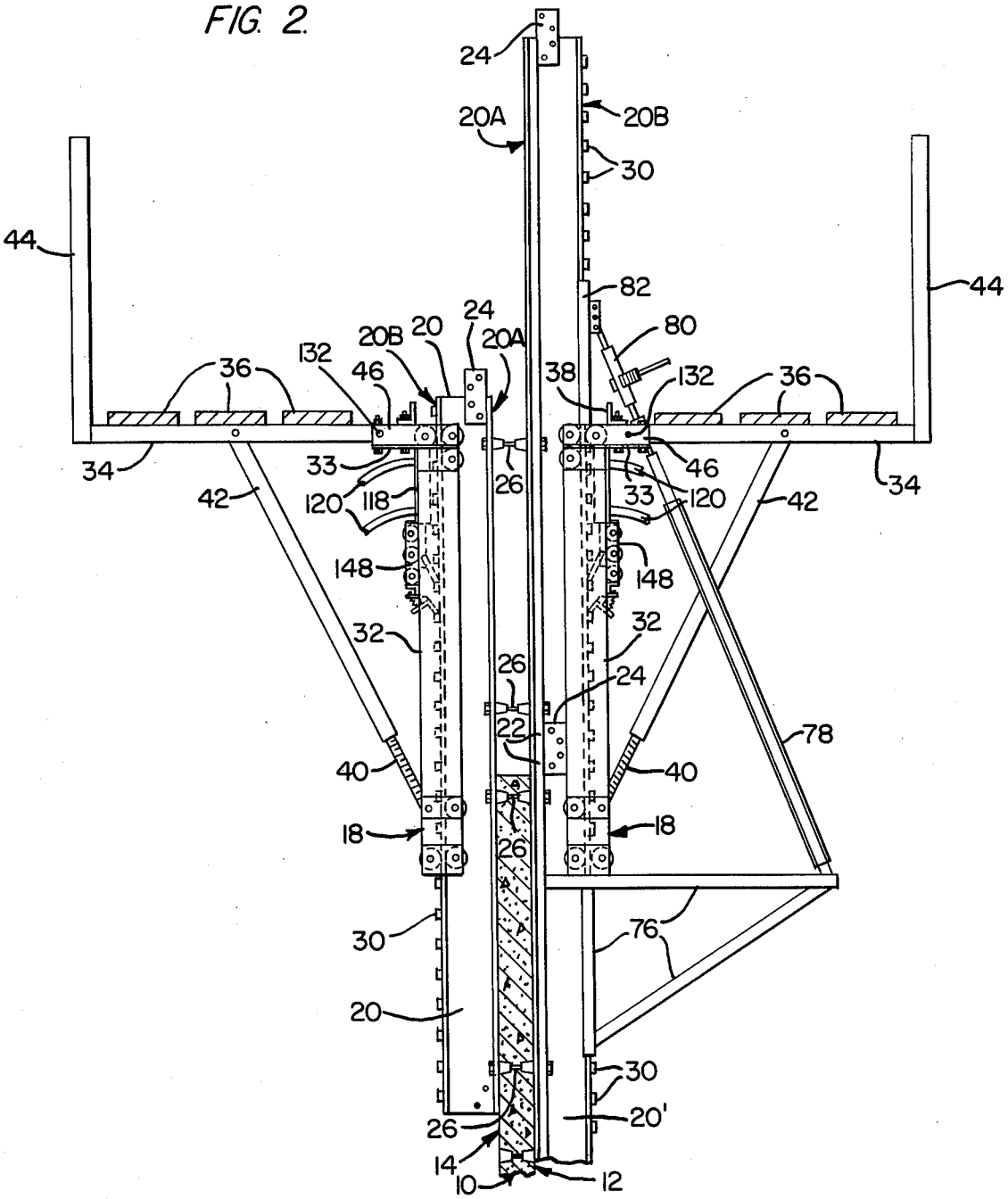
FIG. 2 is a vertical section of the apparatus showing the preferred form of supports and carriage.
Figure 3:
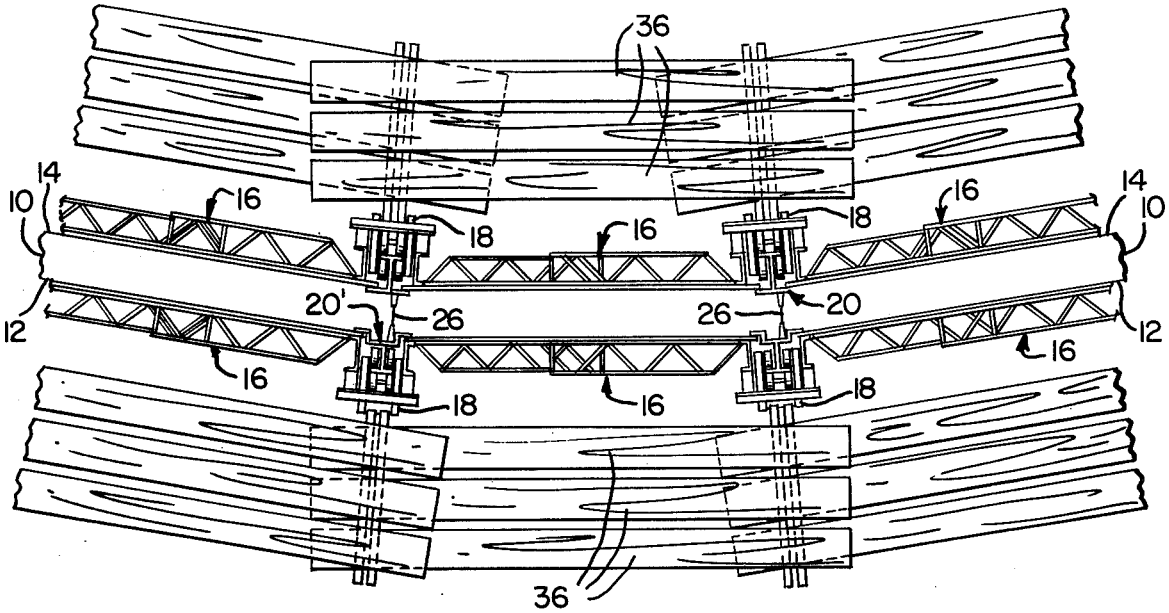
FIG. 3 is a top view of the apparatus shown in FIG. 2.
Figure 5:
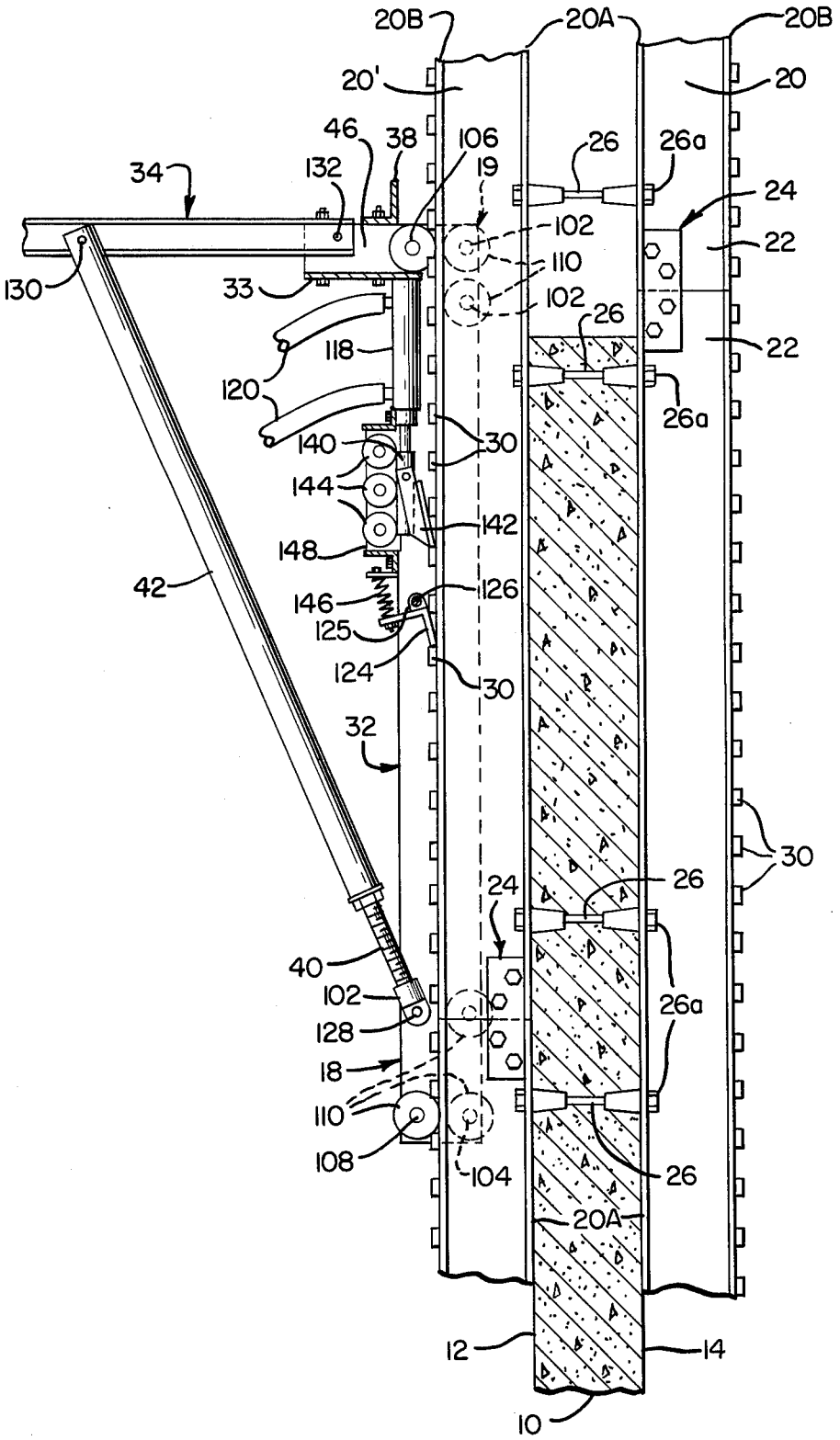
FIG. 5 is an enlarged, vertical section showing the carriage elevating and retaining mechanism.

During the initial construction of a cooling tower and after the ground foundation has been laid, pairs of opposed, spaced-apart, generally vertical supports or H-beams, designated 20 for the inside 14 and 20' for the outside 12, are anchored on the foundation. Each support 20 and 20', not shown in FIG. 1 burt located at each carriage 18, is 20–30 feet long and is composed of several sections 22 of extruded aluminum, generally H-shaped beams, jointed at their ends by bolted plates 24 as shown in FIGS. 2 and 5. The beams of each pair are separeated from each other by a distance while will generally be the thickness of the wall 10 being formed, which at the base of a tower is about 30 inches. The beams are spaced apart, as desired, as best shown in FIG. 5, by a plurality of horizontal spacers or internally threaded inserts 26 attached to the beam flanges 20A by bolts **26*a* before concrete is poured between the beams. Each pair of beams are separated by about 10 feet from similar pairs around the wall so that the beams are located at spaced intervals completely along both the inner and outer wall surfaces 12, 14. As the concrete is poured between the beams and the wall increases in height, a lower section of each beam is detached from the side of the wall 10 by removing bolts 26*a* from the spacers 26, leaving the spacers in the wall. Then the section is attached to the top of the same beam. As the concrete cures, the lower sections of each support held tightly against the wall surfaces easily support the carriages 18 and other structures mounted on them. The beam sections 22 may be lifted into new position by a simple block and tackle or other lifting means mounted on the carriages 18. The beams 20–20' are also provided with spaced apart lugs 30 (FIG. 2) permanently affixed to the outer flange 20B** of each beam for a purpose later described.

A plurality of carriages 18, shown in FIGS. 1, 2, 3, 4, 5 and 6, are separately mounted for vertical movement on beams 20–20' and adjacent carriages support there between concrete form assemblies 16 which shape the surfaces of the wall being formed. Additionally, as shown on FIG. 2, the carriages provide a working platform for men and equipment which extends entirely around the wall being formed.

Each carriage 18, reference being made to FIGS. 2, 4, 5 and 6, includes a pair of similar frames 19 composed of several common structural beams welded and bolted together to form a strong, unitary structure. In detail and as shown in FIG. 2, each frame includes a vertical channel 32, which is welded to a horizontal tubing 46, which in turn is bolted with bolt 132, to channel 34, which is welded to channel 44. Two adjacent frames 19, one being constructed opposite hand, are jointed together to form each carriage 18 mounted on a beam 20 by bolted connector plates 33 (FIG. 5), angle 38, roller frame 148, and machine bolts 108, 126, 128, 130 and 132, which also serve as axles to other components. A pipe 42 and a thread rod assembly 40 are bolted between adjacent frames 19, and serve as an adjustable support to channel 34. Wheels 110 are attached to channel 32 and tube 46 of each frame by axles 102, 104, 106 and 108, and ride against opposing sides of the two outer flanges 20B of the beam holding the carriage against the beam.

A hydraulic jack 118 (FIG. 5) is attached to plate 33 and roller frame 148 in each carriage by bolts and mounts and exerts upward thrust against the carriage when hydraulic pressure is supplied through flexible hose 120. A reciprocating bar 140 is attached to the ram of the hydraulic jack 118, which in turn has a pivoted pawl 142 which is spring loaded (spring not shown) to insure positive engagement between pawl 142 and lug 30 on beam 20-20'.

Further, wheels 144 are mounted on roller frame 148 which extends between adjacent beams 32, and are in rolling contact with reciprocating bar 140 to resist lateral forces on bar 140 and prevent disengagement between pawl 142 and lugs 30. In addition, a follower pawl 124 welded to a short pipe 125, which in turn is mounted for rotation on a shaft 126 extending between beams 32, engages lugs 30 and is held in engagement by spring 146.

Normally, the carriages progress in an upward direction by extension of pawl 142 until tooth 124 engages a higher lug, 30 followed by withdrawal of pawl 142 for relocation against a higher lug 30, and repeating. However, if necessary, a carriage can be lowered by extending hydraulic jack 118 so that the load carried by follower pawl 124 is now transferred to extendable pawl 142 and engaged cleat 30. When the load is thus transferred, pawl 124 can be pivoted so that by slowly retracting the jack will allow the carriage to settle and follower pawl 124 to engage in the next lower cleat 30.

A working scaffold is formed by planks 36 resting on beams 34 of adjacent carriages and an outer rail 44 between which ropes or planks may be placed.

Figure 4:
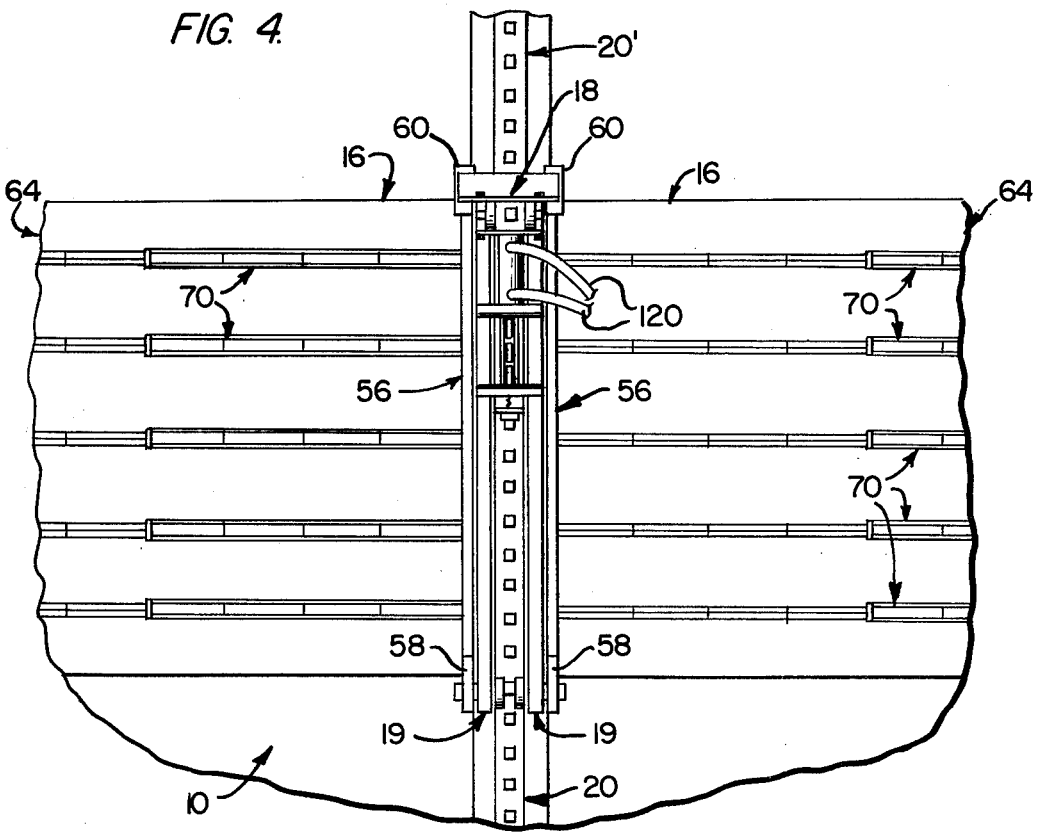
FIG. 4 is an enlarged, fragmentary side elevation of a form or shaping assembly.
Figure 6:
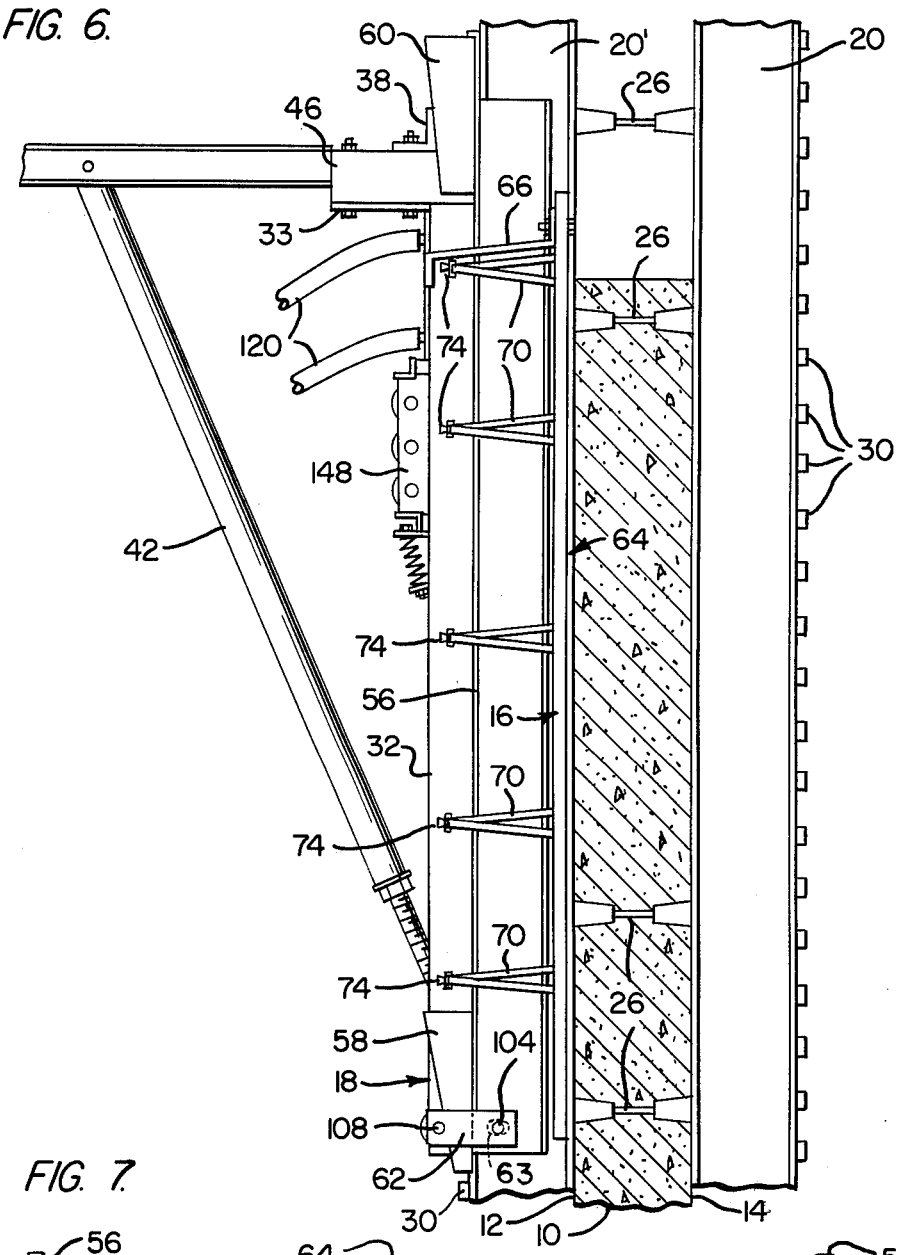
FIG. 6 is an enlarged, vertical section showing the intermediate form in relation to the carriage.
Figure 7:
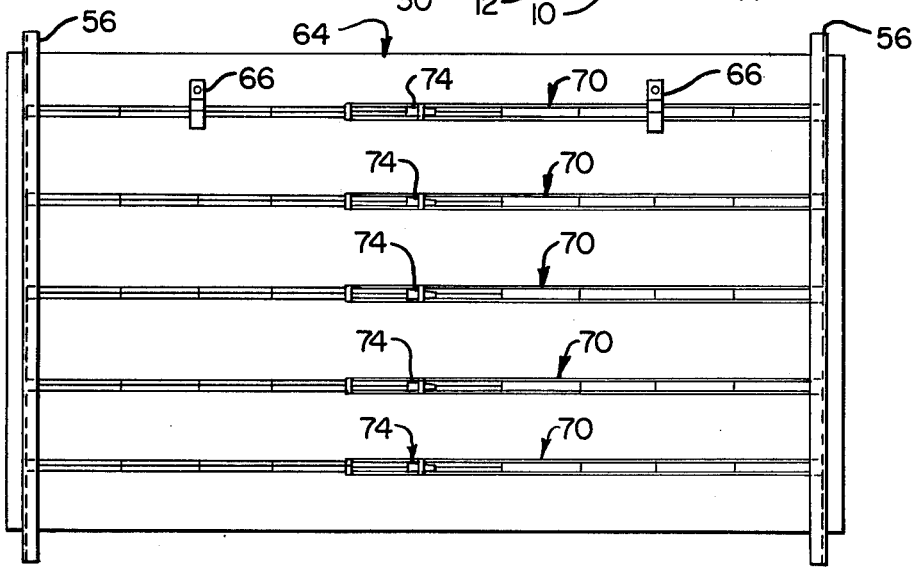
FIG. 7 is a rear elevation of the sheet portion of the form assembly.

Concrete shaping form assemblies 16, generally shown in FIGS. 4, 6 and 7 span the distance between adjacent carriages 18 on both sides of the wall being formed and form and sides of the mold into which fresh concrete is poured. Each form assembly 16 includes a forming sheet 64, two end stiffback channels 56, to which lateral, telescoping steel trusses 70 are bolted, with incorporated wedges 74, that strengthen the trusses 70 when in the proper position. Forming sheet 64 may be 3/4¾ plywood for example, or any ridgid material that can be easily cut, or added to, to provide a smooth casting surface, telescoping trusses 70 provide lateral support for sheet 64, throughout their effective length, once the incorporated wedges 74 are wedged firmly.

The stiffback channels 56 are structural channels that are vertically supported at the bottom by axle 104 which extend beyond beam 32, thru slotted holes 63 (FIGS. 6 and 8) to a retainer plate 62. Further, axle 108 also extends beyond beam 32 to the retainer plate 62. The form panel 64 is held firmly against the extruded flange 20A of beams 20—20'. This is accomplished by wedging the opposite side of the stiffback channel 56 (FIG. 6) with a steel wedge 58 against the extended axle 108.

Similarly the top of channel 56 forces form panel 64 tightly against the extruded flange 20A of beams 20–20', with a hardwood wedge 60, driven between its opposing side and angle 38. With reference the FIGS. 6 and 7, the forming sheet 64 is held vertically by a bracket 66 which merely serves to keep the sheet 64 from falling out when the entire form assembly is unwedged as required while "jacking".

Figure 8:
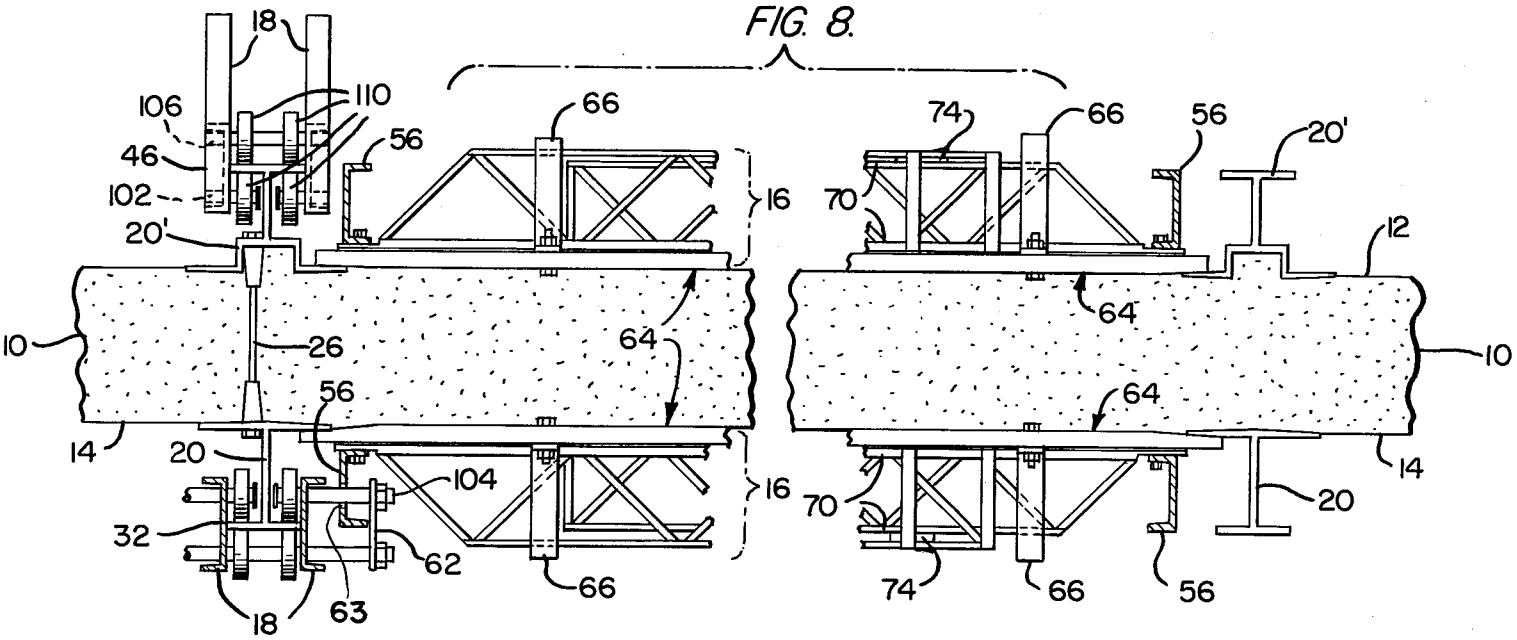
FIG. 8 is a fragmentary horizontal sectional view of the form assembly and related apparatus.

As in the case of cooling tower construction, as the tower moves upward in height the diameter decreases to the throat or neck of the tower, requiring the carriages 18 to become closer together. With reference made to FIG. 8 it can be seen that as the carriages 18 move upward and wedges 74 of the steel trusses 70 being loosened, they are forced together, or can open freely as required. FIG. 8 also illustrates that while the form assembly 16 has its wedges loosened, the form panel 64 is only supported from falling by bracket 66 and can easily be pulled out be sliding it upward from between the support beams 20–20' and the steel trusses 70 for cutting.

The nature of the extruded aluminum beams 22 that make up the support beams 20–20' permits that they can be repeatedly bent or flexed approximately 3 inches over each length without permanent damage.

Using this characteristic, (FIG. 2) a frame 76, comprising two opposite hand weldments are attached to either half 19 of the carriage 18 on one side of the wall 10. The frame 76 encases the outer flange 20B of a portion of beams 20–20' which is adjacent to firm concrete. Similarly a frame 82 is mounted on the top of either half 19 of the carriage 18 which encases the outer flange 20B of beams 20–20' above the form enclosure. An arm 78 is bolted to the lower frame 76, and in turn a stream-bolt ratchet 80 connects to the top frame 82. By extending or contracting the steam-bolt ratchet 80, lateral pressure is applied sufficient to bend the support beam 20 and properly align the wall 10 being cast.

Figure 9:
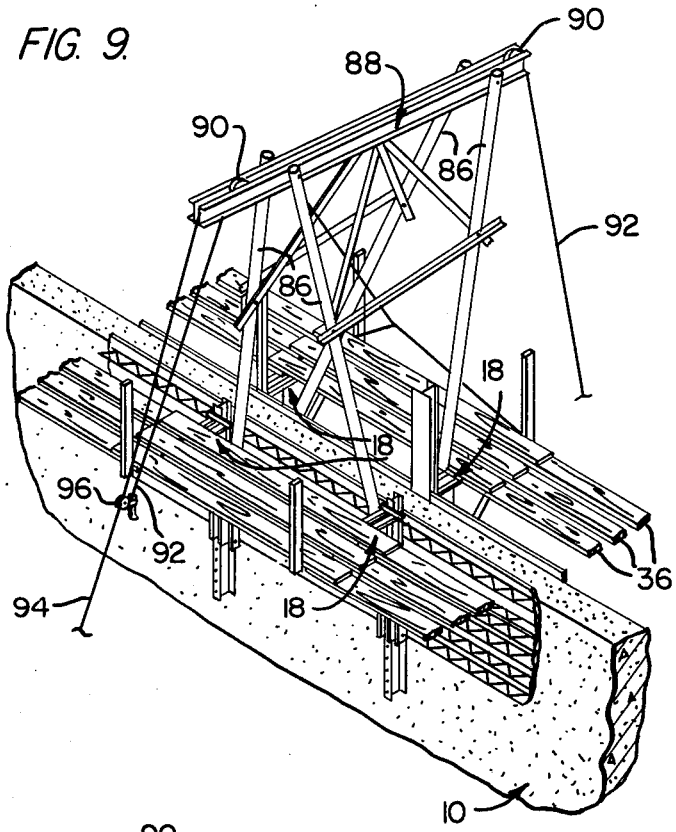
FIG. 9 is a perspective view of the hoisting apparatus.
Figure 10:
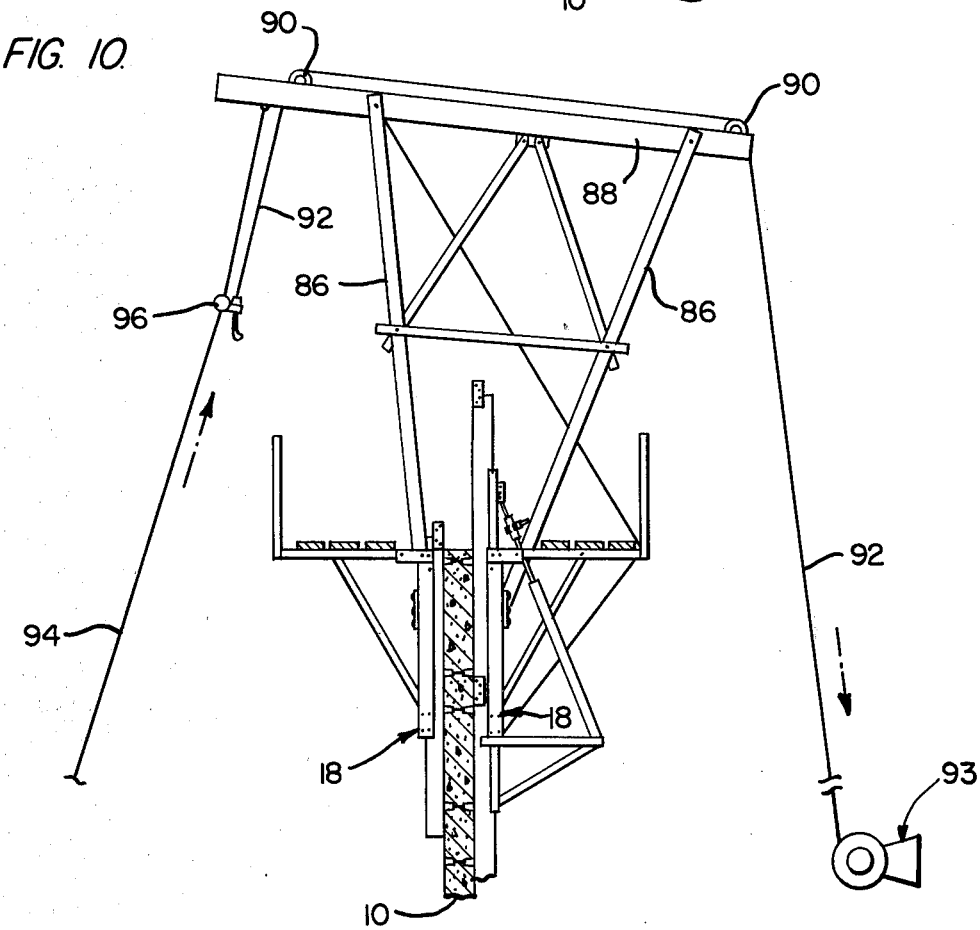
FIG. 10 is a side elevation of the hoisting apparatus.

The vertical strength afforded by such a forming system is also used to best advantage by eliminating excessively high mobile cranes or tower cranes required in high rise construction, as used in previous forming systems. Gantries are erected at selected points around the top of the tower as illustrated in FIGS. 9 and 10. Each gantry is comprised of a beam 88, which is bolted to four pipe legs 86, which in turn are attached to four separate carriages 18. On the upper side of beam 88, two sheaves 90 are attached. A commercial hoisting engine 93 on the ground is used with these gantries so that the load line 92, originating from the hoisting engine on one side of wall 10, is supported over the wall on sheaves 90 so that materials can be hoisted on the opposite side of wall 10 as the arrows indicated in FIG. 10. Also, a stationary static line 94, which extends from beam 88 to a strategic point or concrete hopper on the ground, is used as a guide for the load line 92, which is attached to a small block 96 so that its sheave wheel rolls on static line 94. The static line 94 serves to make the ground loading point (not shown) central, which expedites concrete handling from a concrete truck or hopper, as well as keeping the workmen from working beneath the scaffolding along the perimeter of the tower.

The two variations in the form surface, or flanges 20A of jack beams 20 and 20', are shown as in cooling tower construction, the outer wall surface 12 is generally ridged and the inner wall surface 14 is generally smooth. The plurality of vertical ribs thus formed on the outside surface 12 of the completed tower serve to induce air turbulance, thus enhancing heat transfer.

In casting the initial courses of the wall, an ordinary general crane is used to raise the plastic concrete from the ground to the working scaffold where it is distributed by wheeled carts to the forms around the periphery of the structure. It will be appreciated that several cranes may be used simultaneously so that such a large structure can be cast at a reasonable rate. When the structure height exceeds reach of the cranes, a number of gantries are attached to selected carriages spaced around the wall. These gantries now provide the means to transport plastic concrete and other materials to the work area. The concrete is raised in buckets (approximately ½ cu. yd. capacity) by cables running over the gantries and returning to hoisting engines on the ground. Thus, the necessity for using a large tower crane is avoided and the work can progress much more quickly and safely than with such a crane.

I claim:

1. Apparatus for forming a concrete wall comprising a. a plurality of generally vertical supports spaced apart along both sides of the wall being formed, each support being located opposite to another support on the other side of the wall and detachably connected to said opposing support by a plurality of spacers some of which are contained in the wall previously formed, each support consisting of separate segments detachably joined together at their ends, and the lower portion of each support being held contiguous the surface of the wall previously formed by said spacers while the upper portion extends above the portion of the wall previously formed.

b. a carriage mounted on each support with means for advancing the carriage upwardly along the supports as the wall is formed, c. a plurality of concrete casting assemblies located along and on both sides of the wall being formed adjacent its top, each assembly supported at its ends by two carriages on adjacent supports and each assembly having a generally vertical casting surface extending between the adjacent supports so that the assemblies and the supports together define a continuous mold extending on top of the wall into which concrete is poured, whereby as the concrete hardens the carriages and assemblies are moved upwardly on the supports to form a new level of wall and, at intervals, support segments are detached from the bottom of each support and attached to the top to provide a continuous track for the carriages, d. each casting surface comprises the inner surfaces of generally horizontal, plywood sheets which combine to form a continuous casting surface, e. each casting assembly comprising a plurality of generally horizontal braces positioned contiguous the outer surface of the plywood sheets to support the sheets while the concrete is setting against the inner surface of said sheets, and f. each casting assembly comprising at least a pair of slotted beams movably carried by adjacent carriages, said plurality of horizontal braces mounted between said slotted beams which are adapted to be wedged against said adjacent carriages, so that by wedging the slotted beams against the carriages the inner surface of the sheets are drawn into contact against the adjacent supports thereby providing said continuous mold.

2. The apparatus defined in claim 1 further including hoisting means attached to said carriages, a ground supported hoisting engine, and a hoisting cable connecting said hoisting engine and said hoisting means.

3. The apparatus defined in claim 2 further including a stationary cable connecting the hoisting means to a central loading point below on which the hoisting cable is guided.

* * * * *